US008291642B2

(12) United States Patent
Jankovsky

(10) Patent No.: US 8,291,642 B2
(45) Date of Patent: Oct. 23, 2012

(54) MOVABLE BARRIER OPERATOR SYNCHRONIZATION SYSTEM AND METHOD

(75) Inventor: Thomas Jason Jankovsky, Chicago, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 869 days.

(21) Appl. No.: 12/164,239

(22) Filed: Jun. 30, 2008

(65) Prior Publication Data

US 2009/0320374 A1 Dec. 31, 2009

(51) Int. Cl.
*E05F 11/00* (2006.01)

(52) U.S. Cl. ..... 49/275; 49/117; 49/118; 49/366; 49/367

(58) Field of Classification Search ..... 49/116, 49/117, 118, 375, 366, 367, 369, 275
See application file for complete search history.

(56) References Cited

U.S. PATENT DOCUMENTS 4,429,492 A * 2/1984 Imhoff ..... 49/367
4,653,229 A * 3/1987 Feucht et al. ..... 49/367
4,663,887 A * 5/1987 Storandt et al. ..... 49/369
4,967,512 A * 11/1990 Schroder et al. ..... 49/367
5,286,967 A 2/1994 Bates
5,651,216 A * 7/1997 Tillmann ..... 49/367
5,729,101 A 3/1998 Richmond et al.
5,944,399 A * 8/1999 Gillispie ..... 312/324
6,286,258 B1 * 9/2001 Bischof et al. ..... 49/127
6,449,904 B1 * 9/2002 Paasonen ..... 49/103
6,564,510 B2 * 5/2003 Juntunen et al. ..... 49/103
6,591,551 B2 * 7/2003 Winkler ..... 49/339
6,877,278 B2 * 4/2005 Karkkainen et al. ..... 49/366
7,187,150 B2 3/2007 Robb et al.
7,332,999 B2 2/2008 Fitzgibbon
7,557,525 B2 * 7/2009 Nguyen et al. ..... 318/135
7,971,316 B2 * 7/2011 Copeland et al. ..... 16/79
2006/0086050 A1 * 4/2006 Matsuyama et al. ..... 49/366
2009/0324235 A1 12/2009 Butler

* cited by examiner

*Primary Examiner* — Jerry Redman
(74) *Attorney, Agent, or Firm* — Fitch Even Tabin & Flannery LLP

(57) ABSTRACT

A first movable barrier operator is actuated in order to move a first movable barrier to a first predetermined position via a first movement and according to a first operating characteristic. A second operating characteristic is selected for moving a second movable barrier to a second predetermined position via a second movement. The second operating characteristic is chosen so that the second movement of the second movable barrier to the second predetermined position does not interfere with the first movement of the first movable barrier to the first predetermined position. A second movable barrier operator is actuated to move the second movable barrier to the second predetermined position via the second movement according to the second operating characteristic.

20 Claims, 2 Drawing Sheets

MOVABLE BARRIER OPERATOR SYNCHRONIZATION SYSTEM AND METHOD

CROSS REFERENCE TO RELATED APPLICATION

U.S. application Ser. No. 12/164,224, filed Jun. 30, 2008, now U.S. Patent No. 8,111,997, titled "Multiple Movable Barrier Operator System and Method", the contents of which are incorporated herein by reference in its entirety.

FIELD OF THE INVENTION

The field of the invention relates to movable barrier operators systems and, more specifically, to operating multiple barrier operator systems.

BACKGROUND

Different types of moveable barrier operators have been sold over the years and these barrier operator systems have been used to actuate various types of moveable barriers. For example, garage door operators have been used to move garage doors and gate operators have been used to open and close gates.

In many such systems, multiple barriers are used. For example, in some gated entry systems, dual gates are employed. When the gates are in a fully closed position, a gap exists between the gates and some approach must be used to secure the gates together to prevent the gates from being opened and thereby prevent unauthorized entry into the area protected by the gates.

In some dual gates systems, a loose chain and padlock are used to secure the two gates together after closure. However, to avoid the inconvenience of using a chain and padlock, other dual gate systems use an overlapping section that surmounts the gap between the gates when the gates are fully closed. This overlapping portion may itself provide locking functionality (e.g., the overlapping section may be a magnetic lock, a solenoid lock, or some similar lock or locking arrangement) to secure the gates together. When gates include an overlapping portion, the gates have to be opened or closed in a specific order to prevent interference or collisions between the gates when the gates are moved.

Some previous systems utilizing overlapping sections have attempted to prevent gate collisions by using a delay feature. More specifically, a control element is used to delay the activation and movement of one of the gates by a set time period in order to prevent collisions between gates. Unfortunately, the speed that gates actually move often depends upon environmental conditions. For instance, if a gate is being propelled (or moving against) a high wind, the gate might move faster (or slower) than expected. Consequently, the delay adjustment approach often proves inadequate in preventing collisions.

Another problem associated with the above-mentioned delay-based approaches is that the delays selected are typically significant amounts of time in order to overcome the potential speed variation and therefore significantly increases the amount of time required to open and close gates. User frustration is created under such circumstances as users may be forced to wait for a gate's movement to be completed. Yet another problem with these previous approaches is that manual adjustments to the delay can only be made by an installer, creating the risk of misadjustments by this installer. In addition, the need to schedule maintenance adjustments by a trained installer creates inconvenience for the gate owner since they are often forced to be present when the adjustments are made. Also, when the installer arrives the environmental conditions that created a need for an adjustment may have changed. For instance, these changed conditions may alter the nature of or entirely remove the problem that necessitated the need for an adjustment. As a result, the adjustments made by the installer may become inadequate and/or be merely a guess.

SUMMARY

Approaches are provided that allow multiple barriers to be opened, closed, or otherwise moved such that the movement of one of the barriers does not interfere with the movement of the other barriers. Collisions between barriers are avoided and changing environmental conditions do not negatively impact or affect system performance. Barrier open and closing times are decreased as compared to previous approaches. In addition, the approaches described herein do not require operator adjustments thereby eliminating the potential for operator misadjustments. Furthermore, the elimination of the need for a trained installer to adjust the system increases user convenience and satisfaction with the system.

In many of these embodiments, a first movable barrier operator is actuated in order to move a first movable barrier to a first predetermined position via a first movement and according to a first operating characteristic. A second operating characteristic is selected for moving a second movable barrier to a second predetermined position via a second movement. The first and second predetermined positions may be the same type of position (e.g., both barriers are closed or both barriers are open), completely different types of positions (e.g., one barrier is closed and one barrier is open), or any combination of open, closed, or intermediate positions. The second operating characteristic is chosen so that the second movement of the second movable barrier to the second predetermined position does not interfere with the first movement of the first movable barrier to the first predetermined position. A second movable barrier operator is actuated to move the second movable barrier to the second predetermined position via the second movement according to the second operating characteristic.

In some examples, the first or second operating characteristics are selected prior to reaching the predetermined position. And, as mentioned the predetermined positions may be selected from a variety of different types of positions. For example, the predetermined positions may be barrier closed positions, barrier intermediate positions (between the open and closed positions), and barrier open positions. Other examples of positions are possible.

The operating characteristics can also be a selected from a variety of different types of characteristics. For example, the operating characteristics may be or relate to barrier speeds, barrier acceleration characteristics, barrier travel periods, or barrier decision positions. Multiple operating characteristics may also be used. In addition, other examples of operating characteristics are possible.

The two operating characteristics may be directly or indirectly related. To take one example, the second operating characteristic selected may be the average speed that is used to move the second movable barrier and this value is selected according to the first average speed of the first movable barrier. In another example, the second operating characteristic is a second instantaneous speed that is used to move the second movable barrier and this value is selected according to a first instantaneous speed of the first movable barrier. In still another example, a speed is chosen to move the second movable barrier and this speed is chosen according to the position of the first movable barrier.

The motors that are used to drive the movable barriers can be operated in a number of different ways. For instance, the motors may be actuated by removing and reapplying power in discrete steps. Other motor operating procedures may also be used.

Thus, approaches are provided that allow multiple barriers to be opened or closed such that the movement of one of the barriers does not interfere with movement of the other barriers. In addition, the approaches described herein do not require operator adjustments thereby eliminating the potential for operator misadjustments. The speed of completing barrier operations is also increased as compared with previous approaches. Further, the elimination of the need for a trained installer to adjust or readjust the system increases user convenience and satisfaction with the system.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DESCRIPTION

Figure 1:
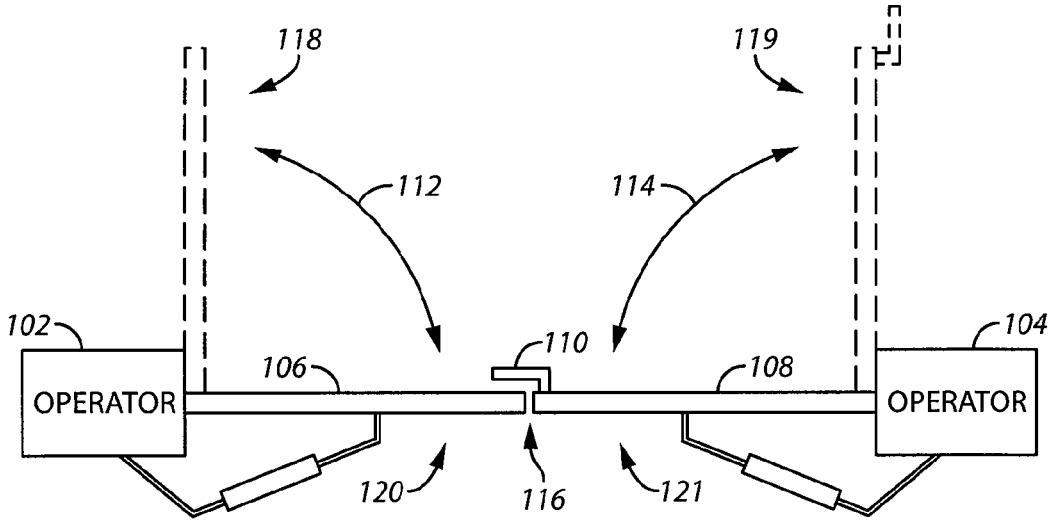
FIG. 1 comprises a block diagram of a multiple barrier operator system according to various embodiments the present invention.

Referring now to FIG. 1, a multiple barrier operator system that is operated to avoid interference between the movements of multiple movable barriers is described. The system includes a first movable barrier operator 102 that is used to actuate a first movable barrier 106 and a second movable barrier operator 104 is actuated to move a second movable barrier 108.

The barriers in the examples described herein are shown as being swinging gates and the barrier operators are gate operators. However, it will be appreciated that the approaches described herein are not limited to swinging gates and gate operators but may be applied to other types of barriers and barrier operators. For example, these approaches may be applied to sliding doors, swinging doors, or sliding gates and their associated operators. Other examples of barriers and barrier operators are possible.

In addition, the number of barriers and barrier operators shown in the examples described herein is two. However, it will be appreciated that the approaches described herein can be extended to include any number of movable barriers and any number of movable barrier operators. Also, multiple movable barriers may be driven by a single movable barrier operator.

The second barrier operator 108 includes or has coupled to it an overlapping portion 110. The overlapping portion 110 may be or may incorporate a solenoid lock, a magnetic lock, or the like. The overlapping portion 110 may also be integral with one of the barriers. In addition, the overlapping portion 110 may itself be partitioned into two portions with one of these portions being coupled to or integral with the first movable barrier 106 and the second portion being coupled to or integral with the second movable barrier 108. In the example of FIG. 1, the overlapping portion 110 is itself a locking mechanism that ensures that the first barrier 106 and the second movable barrier 108 are secured when the first movable barrier 106 and the second movable barrier 108 are both fully closed.

The first movable barrier 106 moves back and forth according to the directions indicated by arrow 112. The second movable barrier 108 moves back and forth according to the directions indicated by arrow 114. As shown in FIG. 1, the first moveable barrier 118 moves back and forth between a fully open position 118 and a fully closed position 120 and, the second movable barrier 108 also moves between a fully open position 119 and a fully closed position 121.

In one example of the operation of the system of FIG. 1, the first movable barrier operator 102 is actuated in order to move the first movable barrier 106 to a first predetermined position via a first movement and according to a first operating characteristic. The predetermined position may be the open position 118, the closed position 120, or some intermediate position (between the open position 118 and the closed position 120). A second operating characteristic is selected for moving a second movable barrier 108 to a second predetermined position via a second movement. The second predetermined position may be the open position 119, the closed position 121, or some intermediate position (between the open position 119 and the closed position 121). The second operating characteristic is chosen so that the second movement of the second movable barrier 108 to the second predetermined position does not interfere with the first movement of the first movable barrier 106 to the first predetermined position. The second movable barrier operator 104 is then actuated to move the second movable barrier 108 to the second predetermined position via the second movement according to the second operating characteristic. The first and second movements can be continuous with small adjustments occurring during the travel.

In one example, the first or second operating characteristics are selected prior to reaching the predetermined position. In other examples, these characteristics can be automatically changed or updated during movement of the barriers. In addition, rather than being a single operating characteristic, the first and second operating characteristics may each include multiple individual operating characteristics.

The operating characteristics themselves can take on a variety of forms. For example, the operating characteristics may be or be related to barrier speeds, barrier acceleration characteristics, barrier travel periods, or barrier decision positions (e.g., positions of the barrier where decisions concerning its movement can be made). Other examples of operating characteristics are possible.

In one example, the second operating characteristic selected and used to move the second movable barrier 108 is an average speed value. This speed is selected based upon an average measured speed of the first movable barrier 106. In another example, the second operating characteristic is an instantaneous speed and this value is selected according to a measured instantaneous speed of the first movable barrier 106. In still another example, a speed is chosen to move the second movable barrier 108 and this speed is chosen according to a measured position of the first movable barrier 106.

The derivation of the second operating characteristic may be performed based upon formula, tables, or other types of relationships with the first operating characteristic. For example, the relationship between the instantaneous speed to move the second movable barrier 108 may be based upon the instantaneous speed of the first movable barrier 106 and this relationship may be specified in a table or similar data structure.

The motors utilized by the movable barrier operators 102 and 104 to move the barriers may be operated according to a variety of different procedures. For example, the second movable barrier operator 104 is actuated by removing and reapplying power to a motor associated with the second movable barrier operator 104 in discrete steps.

The measured characteristics relating to the first movable barrier 106 may be determined and/or obtained based upon a number of different approaches or using a variety of different devices. For example, various types of sensors may be used to determine the accelerations, forces, positions, or speeds of the barriers. These sensors may be placed at suitable locations in the system such as near the motor of the barrier or near the barriers themselves.

Movement of the two barriers 106 and 108 is coordinated to ensure that the two barriers can be moved without colliding. In one example (moving the first barrier 106 from the closed position 120 to the open position 118 and moving the second movable barrier 108 from the closed position 121 to the closed open position 119) the first movable barrier 106 is moved first followed by the second movable barrier 108. On the other hand, an opposite movement (moving the first barrier 106 from the closed open position 118 to the closed position 120 and moving the second movable barrier 108 from the closed open position 119 to the closed position 121) is accomplished by coordinating the motion of the two barriers so that the barrier 106 arrives in the closed position prior to the barrier 108. In so doing, the barriers 106 and 108 can be opened and closed without colliding. Adjustments to the characteristics associated with moving the barriers (e.g., speed, acceleration, or position) can be made to accommodate changes in environmental conditions and other factors without the use of an installer or technician.

Figure 2:
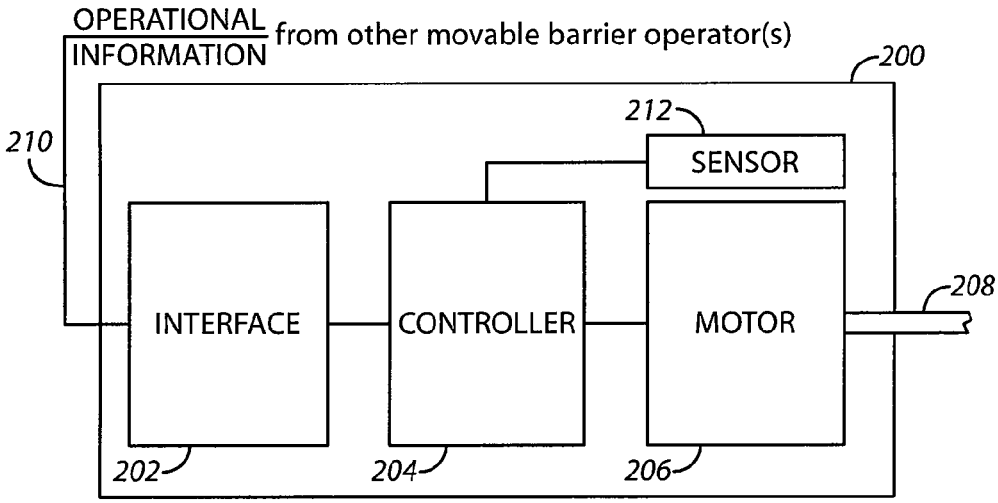
FIG. 2 comprises a block diagram of a movable barrier operator used in a multiple barrier system according to various embodiments of the present invention.

Referring now to FIG. 2, a movable barrier operator 200 used in a multiple barrier system is described. The movable barrier operator 200 includes an interface 202, a controller 204, and a motor 206. The motor 206 is coupled to and moves a barrier 208. The interface 202 receives operational information 210 from one or more other movable barrier operators (not shown). A sensor 212 is used to determine motor (and thus barrier) speed, acceleration, or other characteristics. In addition, other sensors (not shown) or measurement approaches may be utilized to determine other characteristics associated with the movable barrier 208.

The interface 202 is arranged and configured to receive operational information from at least one other movable barrier operator. The information may be received via any communication approach such as radio frequency (RF) signals, light beams, or a hardwired connection. Other approaches are possible. This information may be used to adjust the movement of the second movable barrier 208.

The controller 204 is coupled to the motor 206 and the interface 202. The controller 204 may be a standard digital processing device that is arranged and configured to operate the motor 206 to move a movable barrier 208 to a first predetermined position according to the operational information received at the interface 202 so that the movement of the movable barrier 208 to the first predetermined position does not interfere with the movement of any other movable barrier that is also able to move to some other predetermined position. The predetermined positions may be open position, closed positions, intermediate positions, or some combination of these positions.

The operating characteristics may also take on a number of different forms. For example, the operating characteristics may be or relate to barrier (or motor) speeds, barrier (or motor) acceleration characteristics, barrier travel periods, barrier force or torque characteristics or barrier decision positions. Multiple characteristics may also be used. Other examples of characteristics are also possible.

The motor 206 is any type of motor that is coupled and capable of moving a barrier such as the barrier denoted by reference numeral 208. The motor 206 may also be operated in a number of different ways by the controller 204. For example, the controller 204 may be configured and arranged to remove and reapply power to the motor 206 in discrete steps. Other examples of procedures or approaches for operating the motor 206 are possible.

As shown in FIG. 2, the barrier 208 is a swinging gate. However, it will be appreciated that other types of barriers such as sliding gates or sliding doors may also be used.

Figure 3:
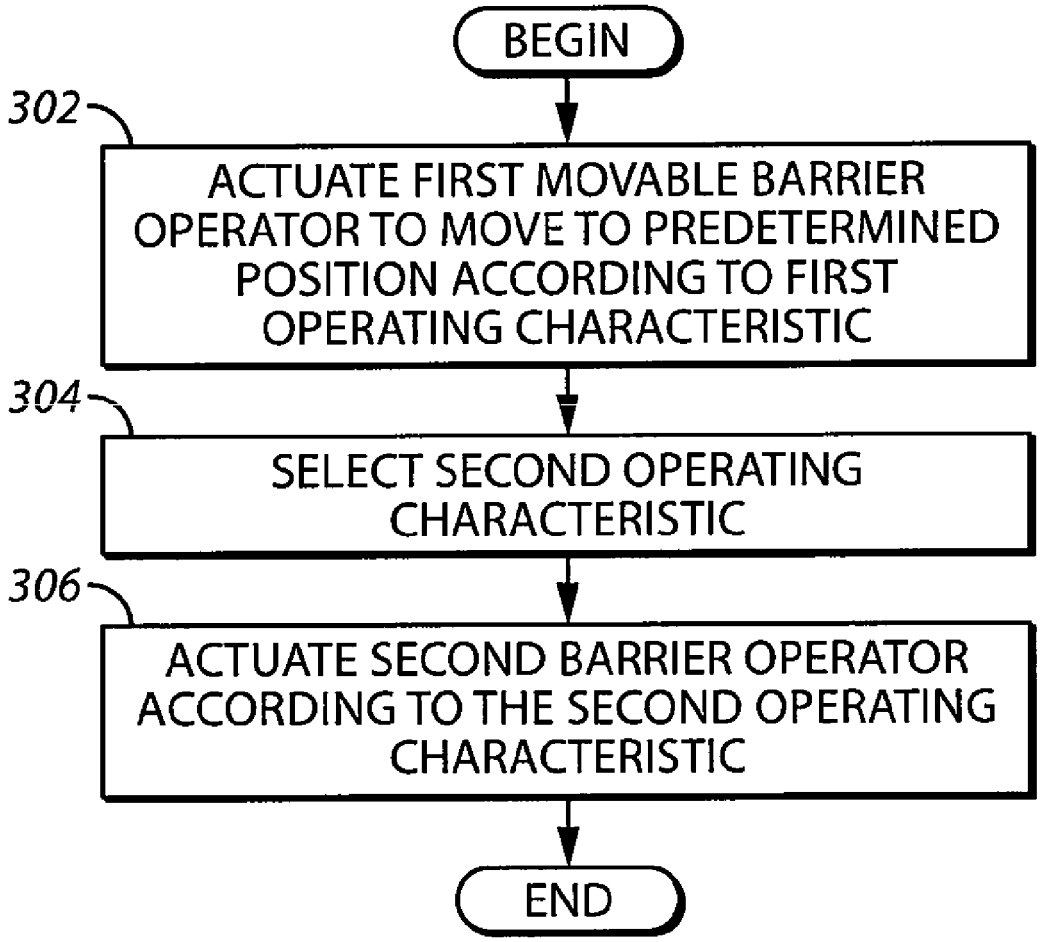
FIG. 3 comprises a flowchart of the operation of a multiple barrier operator system according to various embodiments of the present invention.

Referring now to FIG. 3, one example of an approach for synchronizing and coordinating the operation of multiple barriers is described. At step 302, a first moveable barrier is actuated to move a first movable barrier to a first predetermined position. The movement is accomplished according to a first operating characteristic.

At step 304, a second operating characteristic is selected. The selection of the second operating characteristic and its value may be made based upon a variety of factors. For example, it may be based upon the first operating characteristic, related to the first operating characteristic, derived according to some formula, relationship, some combination of these approaches, or some other approach. The second operating characteristic is selected so that movement of the barriers does not interfere with each other. Although this example is described in terms of a single operating characteristic being used per barrier operator it will be appreciated that multiple operating characteristics may also be used for one or both operators.

The second operating characteristic may be determined dynamically and automatically by the movable barrier operator in one example. Alternatively, the determination of the second operating characteristic may be made at the time of manufacture and programmed into the operator. Other examples of how and when the second operating characteristic are determined are possible.

As mentioned, the operating characteristics may take on a variety of forms. For example, the operating characteristics may be or relate to barrier speeds, barrier acceleration characteristics, barrier travel periods, or barrier decision position. Other examples of operating characteristics are possible.

At step 306, the second movable barrier operator is actuated to move a second movable barrier according to the second operating characteristic to a second predetermined position. As mentioned, movement of either of the barriers does not interfere with movement of the other barrier.

These steps can be performed in such a way that the motion is continuous. Also, the predetermined position can be a locus of predetermined positions allowing the system to be almost continuously corrected to provide a smooth and gentle correction.

Thus, approaches are provided that allow multiple barriers to be opened or closed such that the movement of one of the barriers does not interfere with the other barriers. In other words, the movement of these barriers is synchronized. The speed of barrier operations can be increased using these teachings to thereby reducing user delays. In addition, the approaches described herein do not require operator adjustments thereby eliminating the potential for operator misadjustments. Further, the elimination of the need for a trained installer to adjust the system increases user convenience and satisfaction with the system.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

What is claimed is:

1. A movable barrier operator comprising:

a first movable barrier operator coupled to a first movable barrier, the first movable barrier operator being operable to move the first movable barrier to a first predetermined intermediate position via a first movement and according to a first operating characteristic, the first predetermined intermediate position being relative to and different from both an open position and a closed position of the first movable barrier; and a second movable barrier operator coupled to and operable to move a second movable barrier, the second movable barrier operator comprising a processing device configured and arranged to:

effect movement of the second movable barrier toward a second predetermined position via a second movement according to a second operating characteristic independent of the first operating characteristic of the first movable barrier operator;

receive notification that the first movable barrier has been moved to the first predetermined intermediate position;

modify the second operating characteristic based at least in part on the received notification that the first movable barrier has been moved to the first predetermined intermediate position and a current position of the second movable barrier in response to receiving the notification; and effect movement of the second movable barrier to the second predetermined position according to the modified second operating characteristic and independent of the first operating characteristic of the first movable barrier operator.

2. The operator of claim 1 wherein the second operating characteristic is modified prior to reaching the second predetermined position.

3. The operator of claim 1 wherein the second predetermined position is selected from a group consisting of: a barrier closed position, a barrier intermediate position, and a barrier open position.

4. The operator of claim 3 wherein the second predetermined position is a barrier closed position.

5. The operator of claim 1 wherein the first operating characteristic and the second operating characteristic are selected from a group consisting of: a barrier speed; a barrier acceleration characteristic; a barrier travel period; and a barrier decision position.

6. The operator of claim 1 wherein the second operating characteristic comprises a second average speed to move the second movable barrier, and the second movable barrier operator is configured and arranged to select the second average speed to move the second movable barrier according to a first average speed of the first movable barrier in response to receiving the notification that the first movable barrier has been moved to the first predetermined intermediate position.

7. The operator of claim 1 wherein the second operating characteristic comprises a second instantaneous speed to move the second movable barrier, and the second movable barrier operator is configured and arranged to select the second instantaneous speed to move the second movable barrier according to a first instantaneous speed of the first movable barrier in response to receiving the notification that the first movable barrier has been moved to the first predetermined intermediate position.

8. The operator of claim 1 wherein the second operating characteristic comprises a speed to move the second movable barrier, and the second movable barrier operator is configured and arranged to select the speed to move the second movable barrier according to a position of the first movable barrier in response to receiving the notification that the first movable barrier has been moved to the first predetermined intermediate position.

9. The operator of claim 1 wherein the second movable barrier operator is configured and arranged to remove and reapply power to a motor associated with the second movable barrier operator in discrete steps.

10. The operator of claim 1 wherein the first movable barrier and the second movable barrier are selected from a group comprising a swinging gate, a sliding gate, and a swinging door.

11. A movable barrier operator comprising:

a motor configured to move a first movable barrier toward a first predetermined position;

an interface configured to receive operational information from a second movable barrier operator comprising a notification that a second movable barrier associated with the second movable barrier operator has reached a second predetermined intermediate position relative to and different from both an open position and a closed position of the second movable barrier; and a processing device coupled to the motor and the interface, the processing device arranged and configured to:

operate the motor to move the first movable barrier toward the first predetermined position according to an operating characteristic independent of an operational characteristic of the second movable barrier operator;

modify the operating characteristic based at least in part on the notification received at the interface that the second movable barrier has reached the second predetermined intermediate position and a current position of the second movable barrier in response to the interface receiving the notification; and operate the motor to move the movable barrier to the first predetermined position according to the modified operating characteristic and independent of the operational characteristic of the second movable barrier operator.

12. The operator of claim 11 wherein the first predetermined position is selected from a group consisting of: a barrier closed position, a barrier intermediate position, and a barrier open position of the first movable barrier.

13. The operator of claim 12 wherein the first predetermined position is a barrier closed position.

14. The operator of claim 11 wherein the operating characteristic is selected from a group consisting of: a barrier speed; a barrier acceleration characteristic; a barrier travel period; and a barrier decision position.

15. The operator of claim 11 wherein the processing device is configured and arranged to remove and reapply power to the motor in discrete steps.

16. The moveable barrier operator of claim 11 wherein the operating characteristic of the first movable barrier operator comprises a speed to move the first movable barrier, and wherein the processing device is further arranged and configured to modify the operating characteristic based also at least in part on a position of the second movable barrier when in the second predetermined intermediate position.

17. A movable barrier operator comprising:

a motor configured to move a first movable barrier;

a sensor configured to sense an actual operating characteristic of the first movable barrier;

an interface configured to receive operational information from another a second movable barrier operator comprising a notification that a second movable barrier associated with the second movable barrier operator has been moved to a predetermined intermediate position relative to and different from both an open position and a closed position of the second movable barrier; and a processing device coupled to control the motor, the processing device configured to operate the motor to move the first movable barrier according to a first selected operating characteristic independent of an operational characteristic of the second movable barrier operator, the processing device further configured to select a second selected operating characteristic different from the first selected operating characteristic based at least in part on the notification that the second movable barrier has been moved to the predetermined intermediate position received at the interface and a current position of the first movable barrier in response to the interface receiving the notification, and to operate the motor to move the first movable barrier according to the second selected operating characteristic in response to selecting the second selected operating characteristic.

18. The operator of claim 17 wherein the processing device is further configured to select the second selected operating characteristic based at least in part on a change in the actual operating characteristic of the first movable barrier sensed by the sensor in response to the interface receiving the notification that the second movable barrier has been moved to the predetermined intermediate position.

19. The operator of claim 17 wherein the processing device is further configured to select the second selected operating characteristic based at least in part on a change in the operational information received at the interface in response to the interface receiving the notification that the second movable barrier has been moved to the predetermined intermediate position.

20. The operator of claim 17 wherein the second selected operating characteristic comprises a speed to move the first movable barrier, and wherein the processing device is further configured to select the second selected operating characteristic based also at least in part on a position of the second movable barrier when in the predetermined intermediate position.

* * * * *

UNITED STATES PATENT AND TRADEMARK OFFICE

CERTIFICATE OF CORRECTION

PATENT NO. : 8,291,642 B2
APPLICATION NO. : 12/164239
DATED : October 23, 2012
INVENTOR(S) : Thomas Jason Jankovsky It is certified that error appears in the above-identified patent and that said Letters Patent is hereby corrected as shown below:

IN THE CLAIMS:

Column 9, Claim 17, Line 30; change "from another a" to -- from a --

Signed and Sealed this
Nineteenth Day of March, 2013

Teresa Stanek Rea

Teresa Stanek Rea
*Acting Director of the United States Patent and Trademark Office*